US006715241B2

(12) United States Patent
Gelin et al.

(10) Patent No.: US 6,715,241 B2
(45) Date of Patent: Apr. 6, 2004

(54) LIGHTWEIGHT SOUND-DEADENING BOARD

(75) Inventors: Lawrence J. Gelin, Littleton, CO (US); Brandon D. Tinianov, Littleton, CO (US); Steve Dawson, Denver, CO (US); Mauro Vittorio Battaglioli, Lone Tree, CO (US); Ralph Michael Fay, Lakewood, CO (US); Francis Babineau, Parker, CO (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/981,490

(22) Filed: Oct. 16, 2001

(65) Prior Publication Data

US 2003/0070367 A1 Apr. 17, 2003

(51) Int. Cl.[7] ..... E04B 1/74
(52) U.S. Cl. ..... 52/144; 52/145; 52/481.1
(58) Field of Search ..... 52/145, 144, 481.1, 52/733.2

(56) References Cited

U.S. PATENT DOCUMENTS

| | | | | | |
|---|---|---|---|---|---|
| 2,001,733 | A | * | 5/1935 | Kellogg | 52/144 |
| 2,096,233 | A | * | 10/1937 | Ericson | 181/290 |
| 2,357,560 | A | * | 9/1944 | Taforo, Jr. | 52/145 |
| 3,871,153 | A | * | 3/1975 | Birum, Jr. | 52/794.1 |
| 3,878,032 | A | * | 4/1975 | Larsson | 428/101 |
| 4,702,046 | A | * | 10/1987 | Haugen et al. | 52/144 |
| 4,879,157 | A | * | 11/1989 | Pankatz | 428/157 |
| 5,024,033 | A | * | 6/1991 | Anderson | 52/407 |
| 5,709,053 | A | * | 1/1998 | Kuroda | 52/145 |
| 5,737,895 | A | * | 4/1998 | Perrin | 52/745.1 |
| 6,125,608 | A | * | 10/2000 | Charlson | 52/733.2 |

* cited by examiner

*Primary Examiner*—Carl D. Friedman
*Assistant Examiner*—Basil Katcheves
(74) *Attorney, Agent, or Firm*—Robert D. Touslee

(57) ABSTRACT

Building component assemblies include a sound-deadening board having defined compressional stiffness positioned between a framing member and an assembly board.

6 Claims, 2 Drawing Sheets

LIGHTWEIGHT SOUND-DEADENING BOARD

BACKGROUND OF THE INVENTION

1. Field of the Invention

The present invention relates generally to building materials and more particularly to materials used for sound insulation.

2. Background Information

In building modern structures, such as single-family houses or commercial buildings, an important factor to consider is noise control. In order to provide a quiet environment, sounds originating from sources such as televisions or conversation must be controlled and reduced to comfortable sound pressure levels. To achieve such an environment, builders and designers must address a multitude of factors, among them the construction and composition of building component assemblies that separate rooms from other rooms or from the outside environment. Such assemblies may, for example, take form as interior walls, exterior walls, ceilings, or floors of a building.

The term "transmission loss" is expressed in decibels (db) and refers to the ratio of the sound energy striking an assembly to the sound energy transmitted through the assembly. A high transmission loss indicates that very little sound energy (relative to the striking sound energy) is being transmitted through an assembly. However, transmission loss varies depending on the frequency of the striking sound energy, i.e., low frequency sounds generally result in lesser transmission loss than high frequency sounds. In order to measure and compare the sound performances of different materials and assemblies (i.e., their abilities to block or absorb sound energy), while also taking into account the varying transmission losses associated with different sound frequencies, builders and designers typically use a single-number rating called Sound Transmission Class (STC), as described by the American Society For Testing and Materials (ASTM). This rating is calculated by measuring, in decibels, the transmission loss at several frequencies under controlled test conditions and then calculating the single-number rating from a prescribed method. When an actual constructed system is concerned (i.e., where conditions such as absorption and interior volume are not controlled in a laboratory environment), the single-number rating describing the acoustical performance of such a system can be expressed as a field STC rating (FSTC), which approximates a STC rating when tested on-site. The higher the FSTC rating of a constructed system, the greater the transmission loss.

A conventional wall assembly 300 (called a wood stud wall) is shown in FIG. 3 and consists of two gypsum boards 303 (also referred to as drywall or sheetrock skins) attached directly to either sides of wood studs 301. The space between the wood studs 301 may be filled with some type of fibrous insulation 305 (e.g., fiber glass batts). A wall assembly such as assembly 300 generally results in transmission loss values between STC 30 and STC 36, because although the cavity area between the wood studs 301 is filled with sound insulation material 305, sound energy can easily pass through the structural connections between the wood studs 301 and the gypsum boards 303. Accordingly, assembly 300 is generally ineffective in reducing sound energy transmission.

Several methods are currently used by builders to produce wall and ceiling/floor assemblies with higher FSTC ratings than the performance of a basic wood stud configuration. One such method is the use of resilient channels in a wall assembly 400, shown in FIG. 4*a*. This method involves inserting one or more thin metal channels 407 between one of the drywall skins 403 and framing members 401. The resilient channels 407 act as shock absorbers, structural breaks, and leaf springs, reducing the transmission of vibrations between a drywall skin 403 and the framing members 401. However, the resilient channel technique is difficult to install correctly and requires excessive labor costs. It is very easy to "short out" a resilient channel 407 by improper nailing techniques (e.g., screwing long screws into the wood studs 401 behind the resilient channel 407). When this occurs, the sound isolation of wall assembly 400 remains unimproved. Similarly, problems relating to the difficulty of installing resilient channels may result when the technique is used to sound-isolate floor-ceiling assemblies.

Other current practices involve staggering the positions of wall studs 401 (as illustrated in FIG. 4*b*) or using double stud construction (as illustrated in FIG. 4*c*). These methods create a larger cavity depth and can reduce the structural connections between wall assembly components 401 and 403, thereby allowing an assembly 400 to achieve relatively high FSTC ratings. However, both of these methods double the cost of framing and increase the thickness of wall assembly 400 by approximately two to four inches.

In addition, various sound absorbing or barrier materials are currently used to provide a structural break between wall studs or floor-ceiling joists and the boards attached to them. Examples of such materials include GyProc® by Georgia-Pacific Gypsum Corporation, 440 Sound-A-Sote™ by Homasote and Temple-Inland SoundChoice™. While capable of providing additional sound-transmission loss, these materials are generally dense and heavy, resulting in high handling and installation costs.

Accordingly, what is needed is a wall or floor-ceiling assembly that includes a material between the framing members and building boards either in sheets or strips that can provide additional substantial sound transmission loss, and is both relatively lightweight and easy to install.

SUMMARY OF THE INVENTION

The present invention is directed to the installation of a lightweight sound-deadening board in sheets or strips in a wall or floor-ceiling assembly without the need for expensive methods, training, or tools. The lightweight board may be made of compressible material with an optimum range of compressibility. This material may be either non-resilient foam or a resilient non-foam material.

According to a first embodiment of the present invention, a building component assembly is provided comprising at least one assembly framing member, at least one assembly board, and at least one sound-deadening board, wherein the sound-deadening board is made of a substantially non-resiliently compressible material with an optimized compressibility, is positioned between the at least one assembly framing member and the at least one assembly board, and has an Equivalent Young's Modulus (bulk modulus of elasticity) between 50 and 600 pounds per square inch and a thickness between ¼ and 1 inch. This value may be achieved through means of basic material properties (true Young's Modulus), or by the physical alteration of the board to make the modulus appear lower when installed in the described manner. Kerfing, grooving, waffle cuts and boring are all examples of such alterations.

According to a second embodiment of the present invention, a building component assembly is provided comprising at least one assembly framing member, at least one assembly board, and at least one sound-deadening board, wherein the sound-deadening board is made of a substantially resiliently compressible non-foam material with an optimized compressibility, is positioned between the at least one assembly framing member and the at least one assembly board, and has an Equivalent Young's Modulus (bulk modulus of elasticity) between 50 and 600 pounds per square inch and a thickness between ¼ and 1 inch. This value may be achieved through means of basic material properties (true Young's Modulus), or by the physical alteration of the board to make the modulus appear lower when installed in the described manner. Kerfing, grooving, waffle cuts and boring are all examples of such alterations.

According to a third embodiment of the present invention, a method of installing a sound-deadening board in building component assembly is provided, comprising the steps of attaching at least one sound-deadening board to at least one assembly framing member, and attaching at least one assembly board to the at least one assembly framing member and at least one sound-deadening board, such that the sound-deadening board is positioned between the assembly board and the assembly framing member, wherein the sound-deadening board is substantially made of a non-resiliently compressible material with an optimized compressibility, is positioned between the at least one assembly framing member and the at least one assembly board and has an Equivalent Young's Modulus (bulk modulus of elasticity) between 50 and 600 pounds per square inch and a thickness between ¼ and 1 inch. This value may be achieved through means of basic material properties (true Young's Modulus), or by the physical alteration of the board to make the modulus appear lower when installed in the described manner. Kerfing, grooving, waffle cuts and boring are all examples of such alterations.

According to a fourth embodiment of the present invention, a method of installing a sound-deadening board in building component assembly is provided, comprising the steps of attaching at least one sound-deadening board to at least one assembly framing member, and attaching at least one assembly board to the at least one assembly framing member and at least one sound-deadening board, such that the sound-deadening board is positioned between the assembly board and the assembly framing member, wherein the sound-deadening board is substantially made of a resiliently compressible non-foam material with an optimized compressibility, is positioned between the at least one assembly framing member and the at least one assembly board and has an Equivalent Young's Modulus (bulk modulus of elasticity) between 50 and 600 pounds per square inch and a thickness between ¼ and 1 inch. This value may be achieved through means of basic material properties (true Young's Modulus), or by the physical alteration of the board to make the modulus appear lower when installed in the described manner. Kerfing, grooving, waffle cuts and boring are all examples of such alterations.

BRIEF DESCRIPTION OF THE DRAWINGS

Other objects and advantages of the present invention will become more apparant from the following detailed description of preferred embodiments, when read in conjunction with the accompanying drawings wherein like elements have been represented by like reference numerals and wherein.

DETAILED DESCRIPTION OF THE INVENTION

Figure 1:
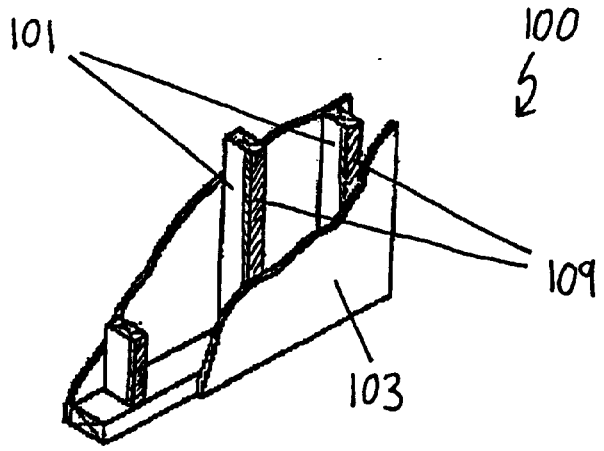
FIG. 1 illustrates a wall assembly built in accordance with the present invention.

FIG. 1 shows a wall assembly 100 including wall studs 101 and wallboards 103 (also called leaves or skins). Studs 101 may be standard wall studs, made of either wood or metal (e.g., steel), and may be lightweight (25 gauge) or heavyweight (20, 18, or 16 gauge). Wallboards 103 may be one of several different varieties of structural skin, such as plasterboard, gypsum board, or plywood.

Integrated into wall assembly 100 and positioned between each stud 101 and wallboard 103 is a sound-deadening board 109 made of either non-resiliently compressible material or resiliently compressible non-foam material. Boards 109 may also be positioned on both sides of studs 101 (not shown). Boards 109 reduce vibration transfer between a wallboard 103 and the studs 101, resulting in enhanced sound isolation between rooms located on either side of assembly 100. Analytical modeling and laboratory testing has shown that optimum sound control performance results when board 109 has an Equivalent Young's Modulus (bulk modulus of elasticity) between 50 and 600 pounds per square inch, a value much lower than the stiffness values associated with conventional materials used in building wall or floor-ceiling assemblies (e.g., gypsum boards and wood studs). These optimum sound control results were found where the sound-deadening board 109 thickness was between ¼ and 1 inch. Modeling and testing also showed that materials with an Equivalent Young's Modulus (bulk modulus of elasticity) between 50 and 500 pounds per square inch, were found to offer broadband improvements with a maximum of 6 to 8 dB improvement at the 1600 Hz one-third octave band. More specifically, materials with an equivalent Young's Modulus (bulk modulus of elasticity between 500 to 600 pounds per square inch, were found to offer broadband improvements with a maximum of 3 to 4 dB improvement at the 1600 Hz one-third octave band. Therefore, materials with Young's Moduli within the described range offer the best sound control performance, while materials with higher Young's Moduli offer some improvement in terms of sound transmission loss.

Existing materials that possess Young's Modulus values less than those of conventional wall or floor-ceiling assembly materials are not currently being used in sound-control applications. An example of an existing material that may be used as board 109, and is non-resiliently compressible, is isocyanurate foam sheathing (also called "iso foam"), which is currently used only for thermally insulating exterior walls and not for sound-deadening interior wall or floor-ceiling assemblies. Another candidate non-resiliently compressional material is blue closed cell sill seal foam, also not normally used for sound-deadening interior wall or floor-ceiling assemblies. EPDM rubber is an example of an existing resiliently compressible non-foam material that may be used as board 109 which is not presently installed for sound control purposes. Of course, any material with an Equivalent Young's Modulus less than the Young's Moduli of conventional wall or floor-ceiling assembly materials may be used in the present invention. As described above, however, an optimal range of sound control performance results when the material has an equivalent Young's Modulus (bulk modulus of elasticity) between 50 and 600 pounds per square inch and a thickness between ¼ and 1 inch.

Board 109 preferably has a thickness of between ¼ and 1 inch and approximately 0.125 to 1 inch and may be manufactured from a wide variety of materials, including, but not limited to, a cellulosic fiber material (e.g., recycled newsprint), perlite, fiber glass, or latex. Board 109 also is preferably manufactured to a density of 1 to 14 pounds per cubic foot, which is less than the density of current sound-control boards. For example, 440 Sound-A-Sote™ has a density of 26 to 28 pounds per cubic foot and Temple-Inland SoundChoice™ has a density of 15 to 20 pounds per cubic foot. Board 109 therefore is much lighter and less stiff than current sound-control boards, resulting in greater ease of handling and lower installation costs. Testing has shown that the installation of a sound-deadening board as described above between the skins and studs of a wall assembly can yield STC ratings of 41 or higher. In contrast, an unimproved wall assembly, as mentioned before, has a maximum STC rating of about 36.

Figure 2:
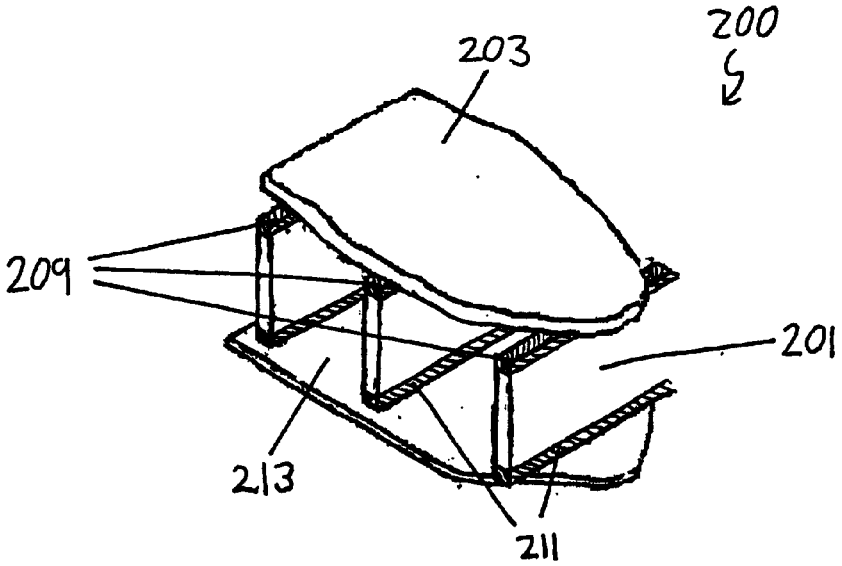
FIG. 2 illustrates a floor-ceiling assembly built in accordance with the present invention.
Figure 3:
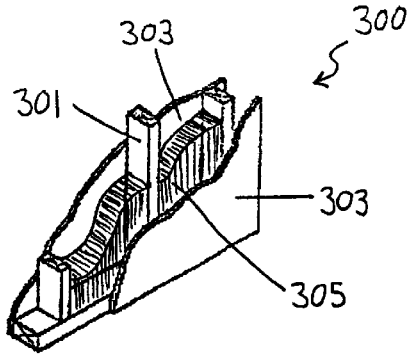
FIG. 3 illustrates a conventional wall assembly.
Figure 4A:
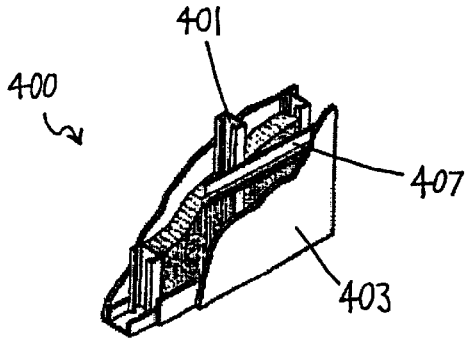
FIGS. 4*a–c* illustrate conventional methods of sound control in wall assemblies.
Figure 4B:
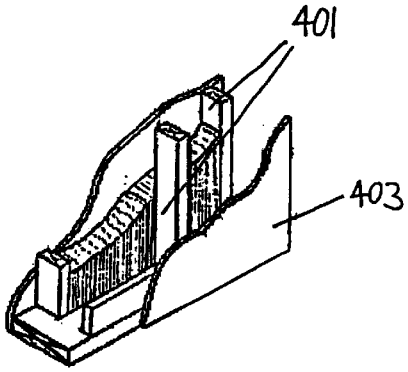
Figure 4C:
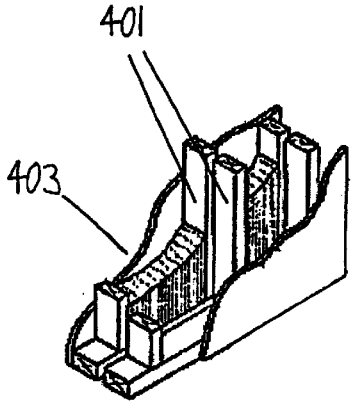

FIG. 2 shows another application of sound-deadening boards meeting the above-described requirements (e.g., the requirements for, Young's Modulus, thickness, and density). In a floor-ceiling assembly 200, boards 209 are positioned between joists 201 and floor layers 203, while boards 211 are positioned between the other sides of joists 201 and ceiling layers 203. Boards 209 and boards 211 may both be made of the same material, or may be made of two different materials, each meeting the above-described requirements. Of course, assembly 200 may include only one of the two boards 209 and 211, or may include both as shown. STC ratings of approximately 50 may be achieved in such a configuration as floor-ceiling assembly 200.

The installation of boards 109 (as well as boards 209 and 211) is simple and does not require careful installation or expert workmanship. An installer may use conventional gas or fluid-powered automatic fasteners to quickly attach the lightweight board to wall studs or floor-ceiling joists. The installer then covers and attaches a layer of structural skin, such as gypsum board, to the studs or joists through the board. The lightweight board may or may not be attached to both sides of a stud or joist.

Boards 109 and 209 are shown respectively in FIGS. 1 and 2 as preferably having widths approximately equal to the edge widths of studs 1021 and joists 201. As an alternative, boards 109 and 209 may, of course, have widths greater than the edge widths of studs 101 and joists 201 and may span from one stud 101 or joist 201 to another. However, testing has shown that it is only essential to separate wallboards from studs (and floor sheets from joists) using sound-deadening material of a width approximately equal to the edge width of the studs (or joists).

A wall or floor-ceiling assembly with an integrated sound-deadening board in accordance with the present invention provides excellent acoustical performance while being the lowest-cost system in terms of both materials and labor cost. This advantage is due to the simplicity of installation, which also establishes high confidence that a wall or floor-ceiling assembly installed with the sound-deadening board possessing the above-described characteristics may also provide some type of thermal benefit (e.g., as with iso foam sheathing) and/or moisture control.

It will be appreciated by those skilled in the art that the present invention can be embodied in other specific form without department from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A building component assembly, comprising:

at least one assembly framing member;

at least one assembly board; and at least one sound-deadening board, wherein the sound-deadening board is made of a substantially non-resiliently compressible material, is positioned between the at least one assembly framing member and the at least one assembly board, has a compressional stiffness of less than about 7840 pounds per square inch, an Equivalent Younq's Modulus (bulk modulus of elasticity) between 500 and 600 pounds per square inch, and a thickness between ¼ and 1 inch.

2. A building component assembly, comprising:

at least one assembly framing member;

at least one assembly board; and at least one sound-deadening board, wherein the sound-deadening board is made of a substantially resiliently compressible non-foam material, is positioned between the at least one assembly framing member and the at least one assembly board, and has a compressional stiffness of less than about 7840 pounds per square inch, and the material has an Equivalent Young's Modulus (bulk modulus of elasticity) between 50 and 600 pounds per square inch and a thickness between ¼ and 1 inch.

3. The framing assembly according to claim 2, the sound-deadening board having an Equivalent Young's Modulus (bulk modulus of elasticity) between 500 and 600 pounds per square inch and a thickness between ¼ and 1 inch.

4. The framing assembly according to claim 2, the sound-deadening board having an Equivalent Young's Modulus (bulk modulus of elasticity) between 50 and 500 pounds per square inch and a thickness between ¼ and 1 inch.

5. A method of installing a sound-deadening board in a building component assembly, comprising the steps of:

attaching at least one sound-deadening board to at least one assembly framing member; and attaching at least one assembly board to the at least one assembly framing member and at least one sound-deadening board, such that the sound-deadening board is positioned between the assembly board and the assembly framing member, wherein the sound-deadening board is substantially made of a resiliently compressible non-foam material, the material having that-has an Equivalent Young's Modulus (bulk modulus of elasticity) between 50 and 600 pounds per square inch, a thickness between ¼ and 1 inch, and a compressional stiffness less than about 7840 pounds per square inch.

6. A building component assembly, comprising:

at least one assembly framing member;

at least one assembly board; and at least one sound-deadening board, wherein the sound-deadening board is made of a substantially non-resiliently compressible material, is positioned between the at least one assembly framing member and the at least one assembly board, and has a compressional stiffness of less than about 7840 pounds per square inch, an Equivalent Young's Modulus (bulk modulus of elasticity) between 50 and 500 pounds per square inch, and a thickness between ¼ and 1 inch.

* * * * *